US007181784B1

(12) United States Patent
Geilear

(10) Patent No.: US 7,181,784 B1
(45) Date of Patent: Feb. 27, 2007

(54) BEDDING STORAGE SYSTEM

(76) Inventor: Sandra L. Geilear, 14 Greenfield St., Brockton, MA (US) 02301

( * ) Notice: Subject to any disclaimer, the term of this patent is extended or adjusted under 35 U.S.C. 154(b) by 0 days.

(21) Appl. No.: 11/387,504

(22) Filed: Mar. 24, 2006

(51) Int. Cl.
*A47C 19/22* (2006.01)

(52) U.S. Cl. ..... 5/308; 5/53.1; 5/2.1

(58) Field of Classification Search ..... 5/2.1, 5/53.1, 58, 183, 159.1, 280, 308
See application file for complete search history.

(56) References Cited

U.S. PATENT DOCUMENTS

| | | | | |
|---|---|---|---|---|
| 795,155 | A | 7/1905 | Nees | |
| 2,691,175 | A | 10/1954 | Brahm et al. | |
| 2,933,737 | A * | 4/1960 | Schiffmann | 5/308 |
| 3,419,921 | A * | 1/1969 | Flood | 5/308 |
| 3,858,253 | A * | 1/1975 | Lauzon | 5/2.1 |
| 4,016,610 | A * | 4/1977 | Ordonez | 5/2.1 |
| 4,869,449 | A | 9/1989 | Goodman | |
| 5,036,556 | A * | 8/1991 | Wieland | 5/53.1 |
| 5,317,888 | A | 6/1994 | Towns | |
| D358,284 | S | 5/1995 | Hill | |
| 6,785,920 | B1 | 9/2004 | Amador, Jr. | |
| 6,986,176 | B1 * | 1/2006 | Lin | 5/53.1 |

* cited by examiner

*Primary Examiner*—Michael Trettel

(57) ABSTRACT

A bedding storage system for storing pillows and bedding includes a headboard being positioned adjacent to a head of a bed. The headboard includes a peripheral wall defining an interior space of the headboard. The peripheral wall includes a pair of side edges each defining one of a pair of side open ends. The side open ends permit the pillows and the bedding to be inserted into the interior space. A medial wall is attached to the peripheral wall and positioned in the interior space to divide the interior space into an upper portion and a lower portion. Each of a plurality of shelf assemblies is positioned in the interior space. Each of the shelf assemblies is extendable from one of the side open ends of the headboard to receive pillows and bedding.

11 Claims, 6 Drawing Sheets

BEDDING STORAGE SYSTEM

BACKGROUND OF THE INVENTION

1. Field of the Invention

The present invention relates to compartmentalized headboards and more particularly pertains to a new compartmentalized headboard for storing pillows and bedding.

2. Description of the Prior Art

The use of compartmentalized headboards is known in the prior art. The prior art commonly teaches sofa beds with compartmented back and head rests or drawer units that are positioned under a bed to store articles.

While these devices fulfill their respective, particular objectives and requirements, the need remains for a system that has certain improved features to allow bedding and pillows to be stored and easily retrieved from a headboard.

SUMMARY OF THE INVENTION

The present invention meets the needs presented above by generally comprising a headboard being positioned adjacent to a head of a bed. The headboard includes a peripheral wall defining an interior space of the headboard. The peripheral wall includes a pair of side edges. Each of the side edges defines one of a pair of side open ends of the headboard to permit the pillows and the bedding to be inserted into the interior space. A medial wall is attached to the peripheral wall and positioned in the interior space to divide the interior space into an upper portion and a lower portion. A plurality of shelf assemblies is positioned in the interior space. The shelf assemblies receive bedding and pillows to facilitate storage of the pillows and the bedding. Each of the shelf assemblies is extendable from one of the side open ends of the headboard to facilitate access to the pillows and the bedding. One of the shelf assemblies is attached to the medial wall and one of the shelf assemblies is coupled to the bottom wall of the headboard.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
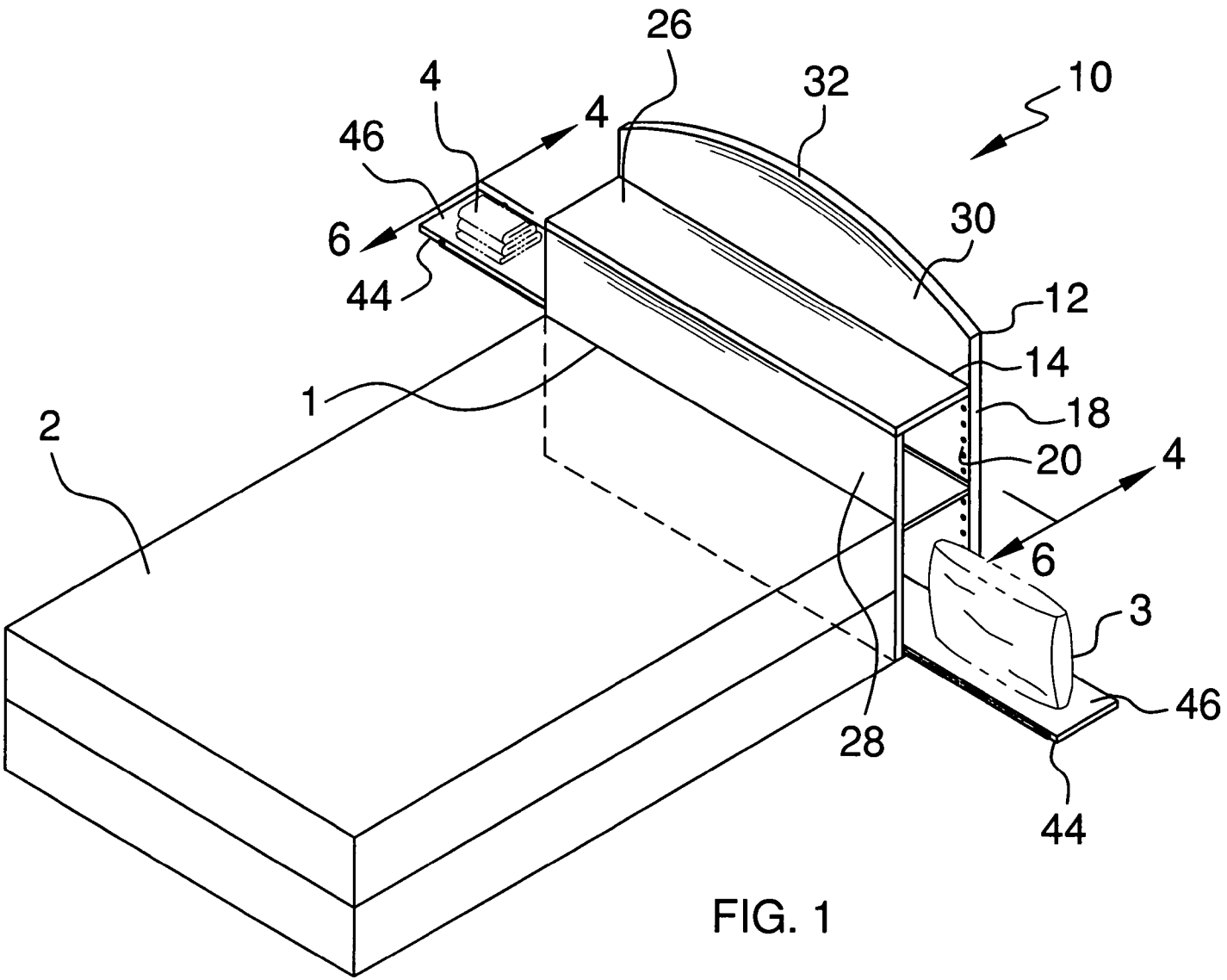
FIG. 1 is a perspective view of a bedding storage system according to the present invention.
Figure 2:
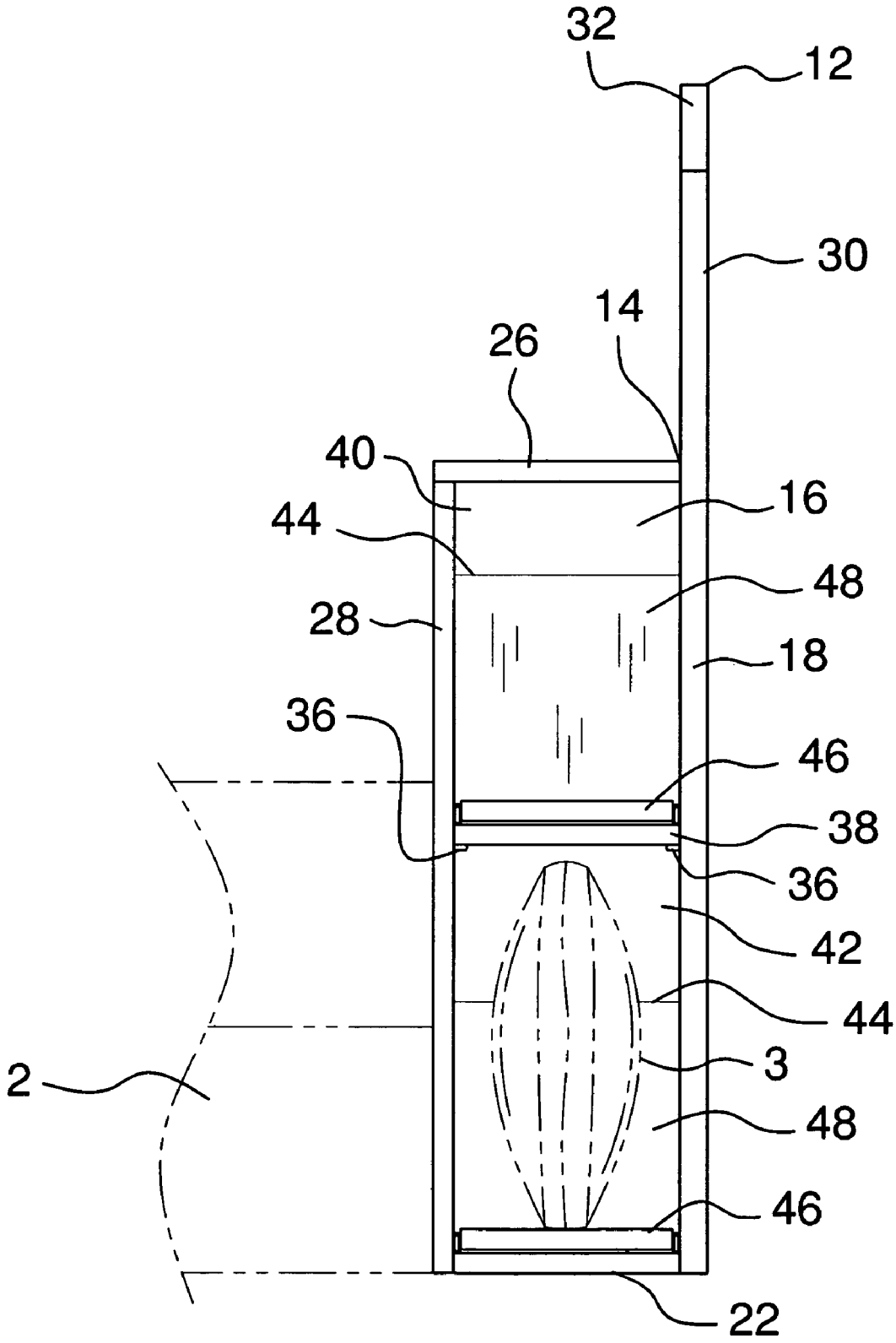
FIG. 2 is a right side view of the present invention.
Figure 3:
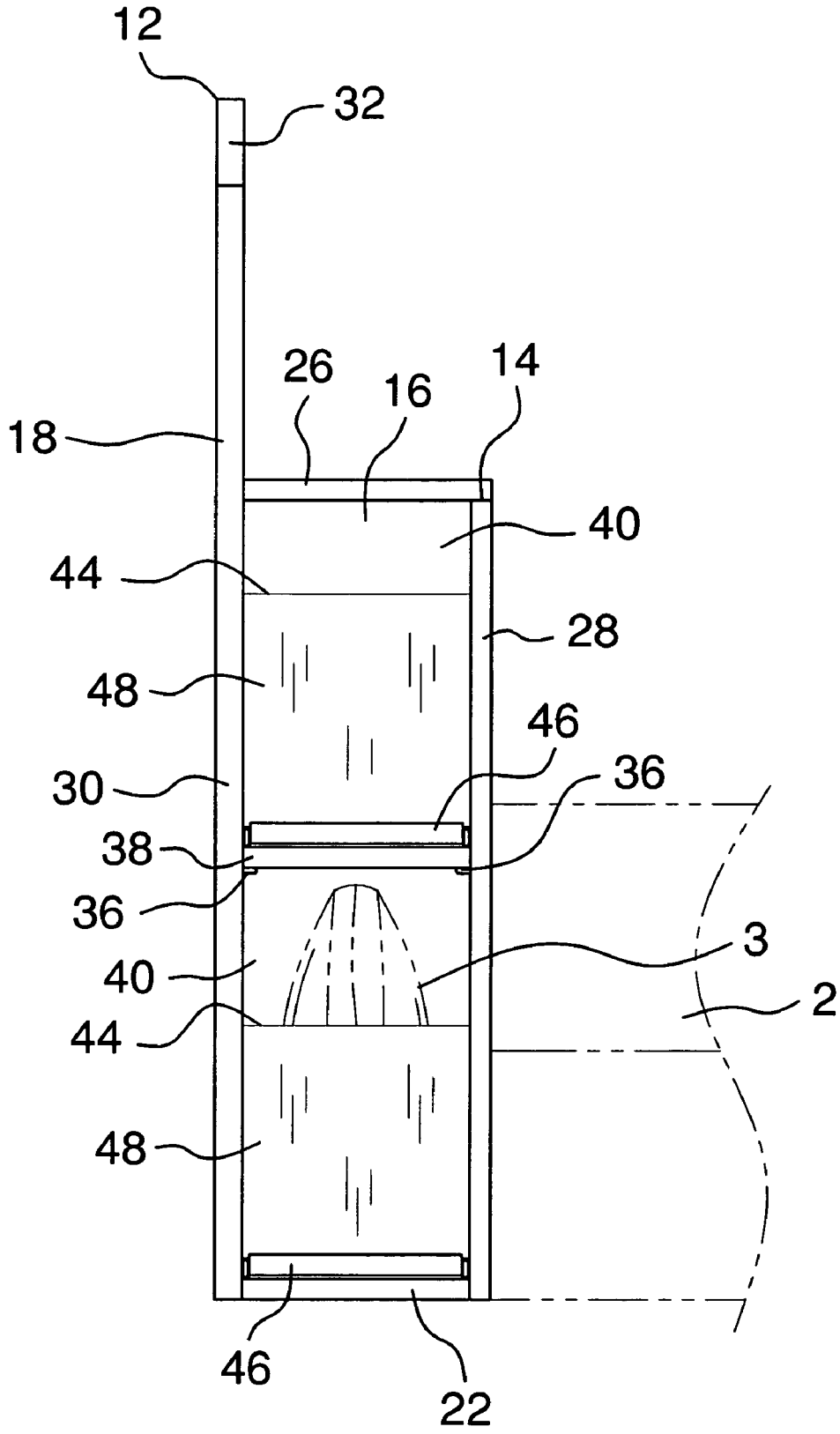
FIG. 3 is a left side view of the present invention.
Figure 4:
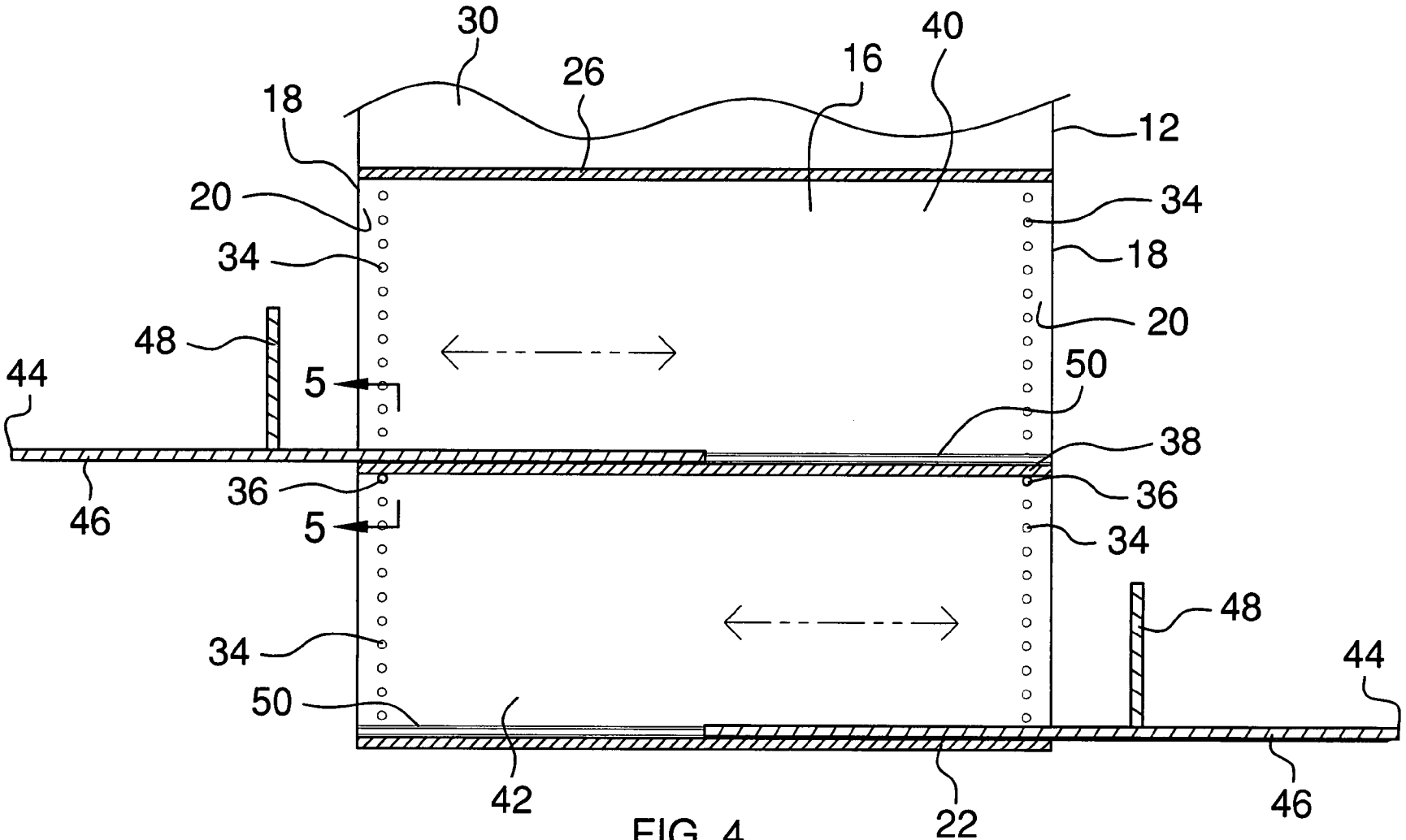
FIG. 4 is a cross-sectional view of the present invention taken along line 4—4 of FIG. 1.
Figure 5:
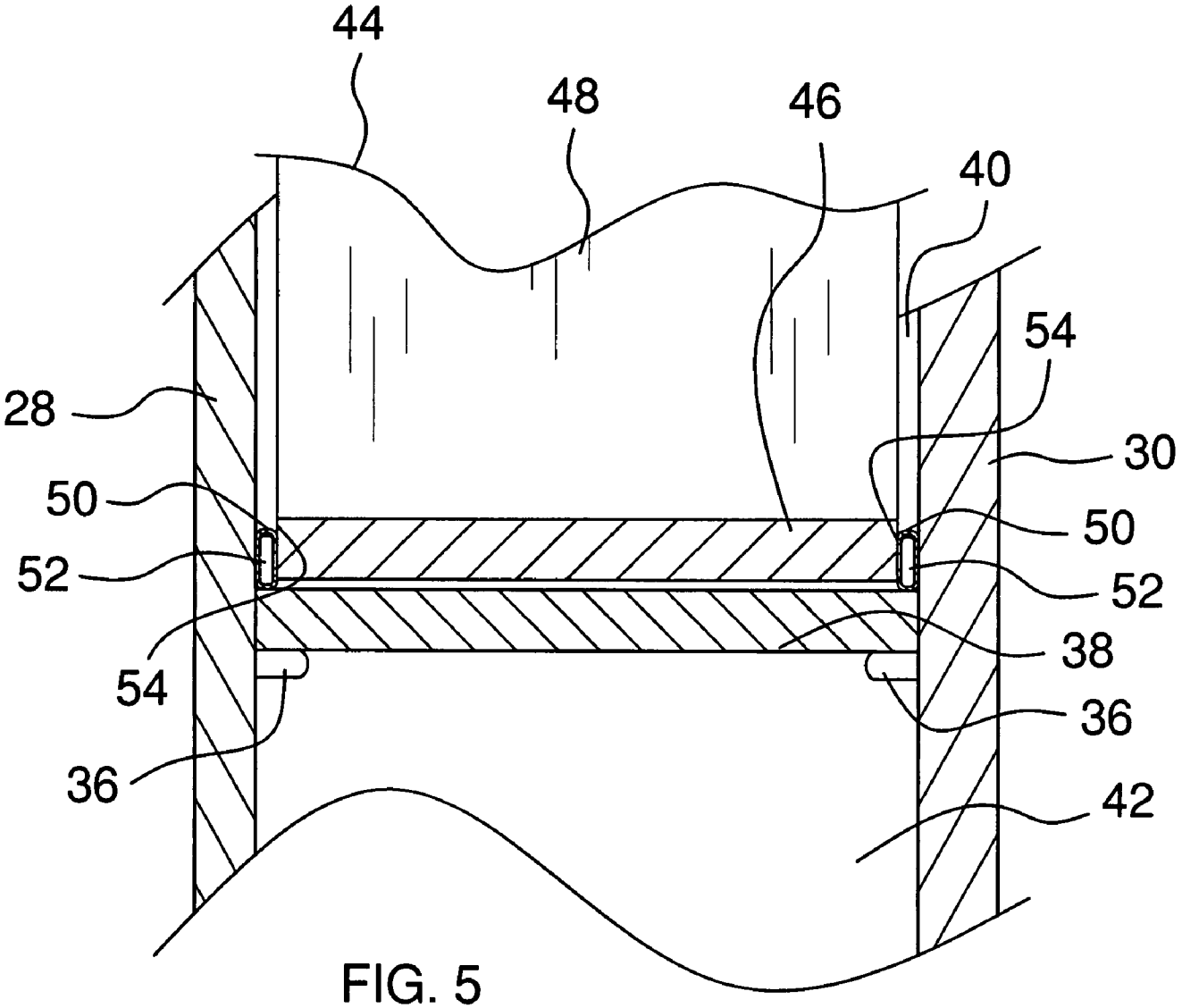
FIG. 5 is a cross-sectional view of the present invention taken along line 5—5 of FIG. 4.
Figure 6:
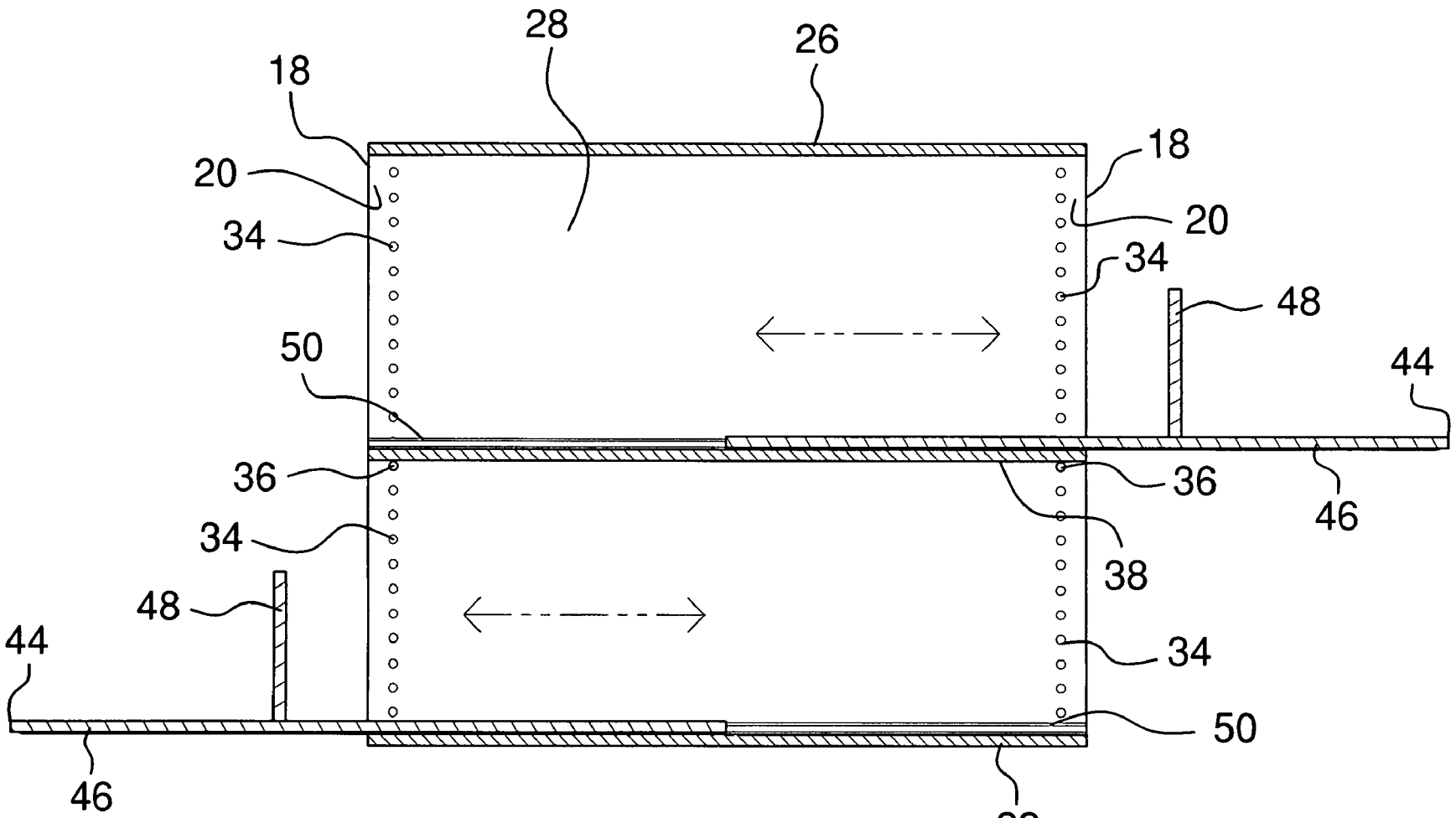
FIG. 6 is a cross-sectional view of the present invention taken along line 6—6 of FIG. 1.

With reference now to the drawings, and in particular to FIGS. 1 through 6 thereof, a new compartmentalized headboard embodying the principles and concepts of the present invention and generally designated by the reference numeral 10 will be described.

As best illustrated in FIGS. 1 through 6, the bedding storage system 10 generally comprises a headboard 12 that is positioned adjacent to a head 1 of a bed 2. The headboard 12 includes a peripheral wall 14 defining an interior space 16 of the headboard 12. The peripheral wall 14 includes a pair of side edges 18. Each of the side edges 18 defines one of a pair of side open ends 20 of the headboard 12 to permit pillows 3 and bedding 4 to be inserted into the interior space 16. The peripheral wall 14 includes a bottom wall 22 positioned on a support surface. A top wall 26 is positioned in a spaced relationship above the bottom wall 22. A front wall 28 is coupled to and extends between the bottom wall 22 and the top wall 26. The front wall 28 is positioned adjacent the head 1 of the bed 2. A rear wall 30 is coupled to the bottom wall 22 and the top wall 26. The rear wall 30 has an upper edge 32 being positioned above the top wall 26. The rear wall 30 inhibits items placed on the top wall 26 from falling behind the headboard 12.

Additionally, the headboard 12 has a plurality of apertures 34. A portion of the apertures 34 extend into the front wall 28 from the interior space 16 and are positioned adjacent the side edges 18 of the peripheral wall 14. Another portion of the apertures 34 extend into the rear wall 30 from the interior space 16 and are positioned adjacent the side edges 18 of the peripheral wall 14. The apertures 34 are arranged in columns and extend between the top wall 26 and the bottom wall 22. Each of a plurality of pegs 36 is insertable into one of the apertures 34 of one of the columns. The pegs 36 are positioned an equal distance from the bottom wall 22. A height of the pegs 36 above the bottom wall 22 is adjustable.

A medial wall 38 is attached to the peripheral wall 14 and positioned in the interior space 16 to divide the interior space 16 into an upper portion 40 and a lower portion 42. The medial wall 38 extends between the front wall 28 and the rear wall 30. The medial wall 38 is positioned on the pegs 36 when the pegs 36 are positioned in the apertures 34. A distance of the medial wall 38 above the bottom wall 22 is adjustable to permit selective placement of the medial wall 38 in the interior space 16.

Each of a plurality of shelf assemblies 44 is positioned in the interior space 16. The shelf assemblies 44 receive the bedding 4 and the pillows 3 to facilitate storage of the pillows 3 and the bedding 4. Each of the shelf assemblies 44 is extendable from one of the side open ends 20 of the headboard 12 to facilitate access to the pillows 3 and the bedding 4. One of the shelf assemblies 44 is attached to the medial wall 38 and one of the shelf assemblies 44 is coupled to the bottom wall 22 of the headboard 12. Each of the shelf assemblies 44 includes a base panel 46 positioned in the interior space 16 and positioned between the front wall 28 and the rear wall 30. The base panel 46 supports the bedding 4 and the pillows 3 placed on the associated one of the shelf assemblies 44. A divider wall 48 is coupled to the base panel 46 and extends upwardly from the base panel 46. The divider wall 48 extends between the front wall 28 and the rear wall 30 to engage the pillows 3 and the bedding 4 to push the bedding 4 and the pillows 3 out of the interior space 16 when the base panel 46 is extended from the interior space 16.

Each of the shelf assemblies 44 includes a pair of rails 50. One of the pairs of rails 50 of the shelf assemblies 44 is attached to the medial wall 38 and one of the pairs of rails 50 of the shelf assemblies 44 is attached to the bottom wall 22. Each rail of the pairs of rails 50 is positioned adjacent to one of the front wall 28 and the rear wall 30. The base panel 46 is positioned between the rails 50. Each of a plurality of rollers 52 is rotatably coupled to the base panel 46 wherein the base panel 46 has at least two rollers 52 attached to each of a pair of lateral edges 54 of the base panel 46. Each of the rollers 52 is positioned in one of the rails 50 and rolls along a portion of a length of the associated one of the rails 50 to permit extension of the base panel 46 from the rails 50 and one of the side open ends 20.

In use, the base panel 46 of the shelf assemblies 44 is extended from one of the side open ends 20 of the headboard 12 to allow the bedding 4 and the pillows 3 to be placed on the base panel 46. The base panel 46 is slid back into the interior space 16 of the headboard 12 to store the bedding 4 and the pillows 3. Sliding the base panel 46 out of the interior space 16 provides access to the bedding 4 and the pillows 3. The height of the pegs 36 above the bottom wall 22 of the headboard 12 can be adjusted by reinserting the pegs 36 into the apertures 34 and thereby adjusting the height of the medial wall 38 and the shelf assembly 44 coupled to the medial wall 38.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bedding storage system for storing pillows and bedding, the system comprising:

a headboard being positioned adjacent to a head of a bed, said headboard including a peripheral wall defining an interior space of said headboard, said peripheral wall including a pair of side edges, each of said side edges defining one of a pair of side open ends of said headboard to permit the pillows and the bedding to be inserted into said interior space;

a medial wall being attached to said peripheral wall and positioned in said interior space to divide said interior space into an upper portion and a lower portion; and a plurality of shelf assemblies being positioned in said interior space, said shelf assemblies receiving the bedding and the pillows to facilitate storage of the pillows and the bedding, each of said shelf assemblies being extendable from one of said side open ends of said headboard to facilitate access to the pillows and the bedding, one of said shelf assemblies being attached to said medial wall and one of said shelf assemblies being coupled to peripheral wall of said headboard.

2. The system according to claim 1, wherein said peripheral wall includes a bottom wall being positioned on a support surface, one of said shelf assemblies being coupled to said bottom wall; and a top wall being positioned in a spaced relationship above said bottom wall, said medial wall extending between said front wall and said rear wall.

3. The system according to claim 2, wherein said peripheral wall includes a front wall being coupled to and extending between said bottom wall and said top wall, said front wall being positioned adjacent the head of the bed.

4. The system according to claim 3, wherein said peripheral wall includes a rear wall being coupled to said bottom wall and said top wall and being positioned opposite said front wall.

5. The system according to claim 4, wherein said rear wall has an upper edge being positioned above said top wall, said rear wall inhibiting items placed on said top wall from falling behind said headboard.

6. The system according to claim 4, wherein said headboard has a plurality of apertures, a portion of said apertures extending into said front wall from said interior space and being positioned adjacent said side edges of said peripheral wall, a portion of said apertures extending into said rear wall from said interior space and being positioned adjacent said side edges of said peripheral wall, said apertures being arranged in columns and extending between said top wall and said bottom wall; and a plurality of pegs, each of said pegs being insertable into one of said apertures of one of said columns, each of said pegs being positioned an equal distance from said bottom wall, a height of said pegs above said bottom wall being adjustable, said medial wall being positioned on said pegs when said pegs are positioned in said apertures, a distance of said medial wall above said bottom wall being adjustable to permit selective placement of said medial wall in said interior space.

7. The system according to claim 1, wherein each of said shelf assemblies includes a base panel being positioned in said interior space, said base panel supporting bedding and pillows placed on the associated one of said shelf assemblies.

8. The system according to claim 7, wherein each of said shelf assemblies includes a pair of rails, one of said pairs of rails of said shelf assemblies being attached to said medial wall and one of said pairs of rails of said shelf assemblies being attached to a bottom wall of said peripheral wall, said base panel being positioned between said rails.

9. The system according to claim 8, wherein each of said shelf assemblies includes a plurality of rollers, each of said rollers being rotatably coupled to said base panel wherein said base panel has at least two rollers attached to each of a pair of lateral edges of said base panel, each of said rollers being positioned in one of said rails and rolling along a portion of a length of the associated one of said rails to permit extension of said base panel from said rails and one of said side open ends.

10. The system according to claim 7, wherein each of said shelf assemblies includes a divider wall being coupled to said base panel and extending upwardly from said base panel, said divider wall extending between said front wall and said rear wall to engage the pillows and the bedding to push the bedding and pillows out of said interior space when said base panel is extended from said interior space.

11. A bedding storage system for storing pillows and bedding, the system comprising:

a headboard being positioned adjacent to a head of a bed, said headboard including a peripheral wall defining an interior space of said headboard, said peripheral wall including a pair of side edges, each of said side edges defining one of a pair of side open ends of said headboard to permit the pillows and the bedding to be inserted into said interior space, said peripheral wall comprising:

a bottom wall being positioned on a support surface;

a top wall being positioned in a spaced relationship above said bottom wall;

a front wall being coupled to and extending between said bottom wall and said top wall, said front wall being positioned adjacent the head of the bed;

a rear wall being coupled to said bottom wall and said top wall, said rear wall having an upper edge being positioned above said top wall, said rear wall inhibiting items placed on said top wall from falling behind said headboard;

a medial wall being attached to said peripheral wall and positioned in said interior space to divide said interior space into an upper portion and a lower portion, said medial wall extending between said front wall and said rear wall, a distance of said medial wall above said bottom wall being adjustable to permit selective placement of said medial wall in said interior space;

a plurality of shelf assemblies being positioned in said interior space, said shelf assemblies receiving the bedding and the pillows to facilitate storage of the pillows and the bedding, each of said shelf assemblies being extendable from one of said side open ends of said headboard to facilitate access to the pillows and the bedding, one of said shelf assemblies being attached to said medial wall and one of said shelf assemblies being coupled to said bottom wall of said headboard, each of said shelf assemblies comprising:

a base panel being positioned in said interior space and positioned between said front wall and said rear wall, said base panel supporting the bedding and the pillows placed on the associated one of said shelf assemblies;

a pair of rails, one of said pairs of rails of said shelf assemblies being attached to said medial wall and one of said pairs of rails of said shelf assemblies being attached to said bottom wall, each rail of said pairs of rails being positioned adjacent to one of said front and rear walls, said base panel being positioned between said rails;

a plurality of rollers, each of said rollers being rotatably coupled to said base panel wherein said base panel has at least two rollers attached to each of a pair of lateral edges of said base panel, each of said rollers being positioned in one of said rails and rolling along a portion of a length of the associated one of said rails to permit extension of said base panel from said rails and one of said side open ends; and a divider wall being coupled to said base panel and extending upwardly from said base panel, said divider wall extending between said front wall and said rear wall to engage the pillows and the bedding to push the bedding and pillows out of said interior space when said base panel is extended from said interior space.

* * * * *